United States Patent [19]

Kurosawa et al.

[11] Patent Number: 4,860,021

[45] Date of Patent: Aug. 22, 1989

[54] PARABOLIC ANTENNA

[75] Inventors: Hiroshi Kurosawa; Izumi Ochiai, both of Tochigi, Japan

[73] Assignee: Hitachi, Ltd., Tokyo, Japan

[21] Appl. No.: 877,206

[22] Filed: Jun. 23, 1986

[30] Foreign Application Priority Data

Jun. 28, 1985 [JP] Japan ..... 60-140304
Sep. 20, 1985 [JP] Japan ..... 60-206460

[51] Int. Cl.[4] ..... H01Q 3/02; H01Q 15/16
[52] U.S. Cl. ..... 343/840; 343/882
[58] Field of Search ..... 343/840, 878, 880, 882, 343/915, 916, 765, 757, 894

[56] References Cited

U.S. PATENT DOCUMENTS 3,351,947 11/1967 Hart ..... 343/840
4,644,365 2/1987 Horning ..... 343/882

FOREIGN PATENT DOCUMENTS 38788 10/1981 European Pat. Off. ..... 343/882
7250 4/1983 European Pat. Off. ..... 343/878
3341099 5/1985 Fed. Rep. of Germany .
2471058 6/1981 France ..... 343/882
129408 10/1981 Japan ..... 343/878
85103 5/1984 Japan ..... 343/880
22802 2/1985 Japan ..... 343/840
62203 4/1985 Japan ..... 343/840

OTHER PUBLICATIONS

Patent Abstracts of Japan, E-324, Jun. 25, 1985, vol. 9, No. 150, Abstract of 60-30202 (2/1985).

*Primary Examiner*—Rolf Hille
*Assistant Examiner*—Michael C. Wimer
*Attorney, Agent, or Firm*—Antonelli, Terry & Wands

[57] ABSTRACT

A parabolic antenna comprises a parabolic reflector having a flange at outer periphery of reflector contiguously and an antenna fitting integrally formed with upper and lower fitting arms to be secured to upper and lower portions of the flange, respectively. The back of the parabolic reflector is fixedly mounted to the antenna fitting through the upper and lower fitting arms and fixed on an antenna support post.

12 Claims, 3 Drawing Sheets

PARABOLIC ANTENNA

BACKGROUND OF THE INVENTION

1. FIELD OF THE INVENTION

This invention relates in general to parabolic antennas and more particularly to a parabolic antenna of the type suitable for preventing a decrease in gain efficiency.

2. DESCRIPTION OF THE PRIOR ART

In receiving Direct Broadcasting Satellite (D.B.S.) communications by means of a parabolic antenna, efficiency of gain is generally affected to a great extent by physical or geometrical accuracy of a parabolic reflector surface and accuracy of the mounting position of a converter relative to the parabolic reflector. Therefore, in order to prevent a decrease in efficiency of gain, it is necessary to place the converter in position with high accuracy as described below and to maintain the geometrical accuracy of the parabolic reflector.

The accuracy of the mount position of the converter withh respect to the parabolic reflector generally depends on the wavelength of radio waves and the positional relationship therebetween must be set with high accuracy of the $\pm\lambda/32$ or less, where $\lambda$ is the wavelength of radio wave and $\lambda/32$ comes to about 0.78 mm for a wavelength of about 2.5 cm of a 12GH radio wave (KU-Band) used in the satellite broadcasting.

To clarify problems incountered in practice, a prior art parabolic antenna will first be explained with reference to FIGS. 5 and 6 respectively illustrating a side view and a rear view of the parabolic antenna fitted on an antenna support.

A parabolic reflector 20 has a rear structure which is integrally formed with a connecting block 21 and reinforcement ribs 26. An antenna fitting 22 fixed on an antenna support post 23 is assembled to the connecting block 21 by tightening screws so that the parabolic reflextor 20 is fixedly mounted to the support post 23. A converter 2 is rigidly connected to a flange of the parabolic reflector 20 by a mount arm 24 connected to a lower portion of the flange, and is adjusted for mount positioning by support bars 25 connected to right and left side edge portions of the parabolic reflector flange positioned about ⅓ of height of the parabolic reflector below the top thereof, in order to hold in position the mount arm 24 connected to the flange lower portion. Consequently, the converter 2 is supported uniformly relative to the parabolic reflector at three points to maintain positional accuracy. The support bars 25 must be curved so as not to intercept a radio wave incident to the parabolic reflector 20. When, in this parabolic antenna, a strong wind exerts a large wind pressure on the parabolic reflector 20, bending moments will be concentrated at the boundary between the connecting block 21 and part of the rear structure of parabolic reflector 20 surrounding the block 21, and the parabolic reflector 20 tends to be distorted permanently about the boundary. In addition, because of the connection of the converter 2 to the parabolic reflector by means of the converter mount arm 24 rigidly secured to the flange lower portion, bending moments are also concentrated to a lower part of the flange, thereby aggravating the tendency of the parabolic reflector toward permanent distortion. The distortion leading to permanent deformation caused in the parabolic reflector will degrade the efficiency of gain.

This disadvantageous distortion and permanent deformation of the elastic parabolic reflector caused by a strong wind can be mitigated in the prior art by increasing the thickness of the parabolic reflector 20 and adding the reinforcement ribs 26 for support of the parabolic reflector rear structure over a wide area so as to increase mechanical strength as shown in FIGS. 5 and 6. This expedient however requires a large amount of materials to be used and results in a complicated structure.

For assuring the accuracy of mounting position of the converter 2 relative to the parabolic reflector 20, on the other hand, the three-point support is adopted as described previously wherein the mount arm 24 of the converter 24 rigidly connected to the flange of the parabolic reflector is supported by the converter arm support bars 25 extending from the both side edge portions of the parabolic reflector flange. Disadvantageously, the converter arm support bars 25 even though not extending across the effective area of the parabolic reflector tend to cause irregular reflection of the radio wavd which in turn becomes an additional factor of degrading the efficiency of gain.

Another prior art reflector as shown in FIGS. 7 and 8 is configured as will be described below to avoid deformation of a parabolic reflector 20 due to pressure of a strong wind exerting on a converter 2 and on a converter mount arm 24. More particularly, bending moments attributable to the wind pressure on the converter 2 can be applied to a fitting 22 without interferring with the parabolic reflector 20 by connecting the converter mount arm 24 directly to the fitting 22 or to a parabolic reflector fixture 27 integral with a connecting block 21. With this construction, however, to obtain highly accurate mounting position of the converter 2 relative to the parabolic reflector 20, positional accuracy between the parabolic reflector 20 and parabolic reflector fixture 27, positional accuracy between the parabolic reflector fixture 27 and fitting 22, positional accuracy between the fitting 22 and converter mount arm 24 and mount accuracy of the converter mount arm 24 to the converter 2 are all required to be extremely high. To meet such a requirement, the individual components must be highly accurate, especially, mount surfaces of the individual components must be machine accurately in the extreme and besides the fixture 27 with connecting block 21 is required to be large sized structurally.

As will be seen from the above, the conventional parabolic antenna needs parts with very high accuracy, and therefore it has been very difficult to significantly improve the efficiency of gain.

SUMMARY OF THE INVENTION

As object of this invention is to provide a parabolic antenna with less degraded efficiency of gain.

According to this invention, to accomplish the above object, a parabolic reflector is reinforced by a flange which is secured to an antenna fitting having upper and lower fitting arms such, that upper and lower portions of the parabolic reflector are respectively mounted to the arms but a central portion of the parabolic reflector is out of contact with the fitting. Therefore, the wind pressure on the parabolic reflector surface is shared by strength of the flange of the parabolic reflector and, is transmitted to the fitting which has a mechanism for adjusting elevation coordinates and then to the support pole through two locations, thereby perventing imminent deformation of the parabolic reflector responsible for degradation of the efficiency of gain.

DESSCRIPTION OF THE PREFERRED EMBODIMENTS

A preferred embodiment of an offset type parabolic antenna according to this invention will be described with reference to FIGS. 1 to 4.

Figure 1:
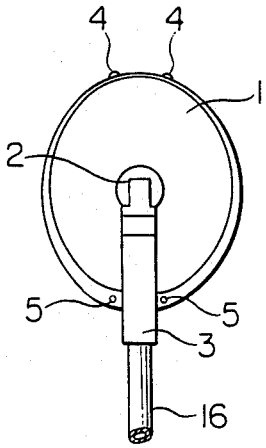
FIGS. 1 is front view showing an offset type parabolic antenna according to an embodiment of the invention wherein it is fitted on an antenna support post (16)
Figure 2:
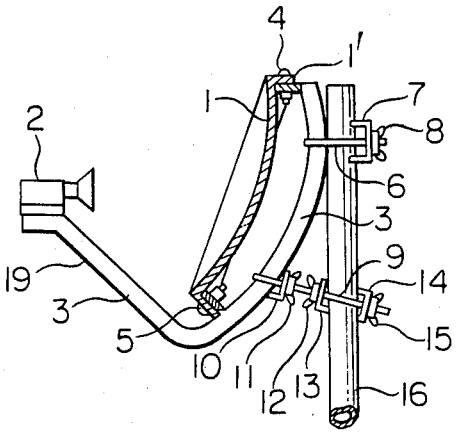
FIG. 2 is a side view showing the FIG. 1 parabolic antenna with a parabolic reflector (1) sectioned.
Figure 4:
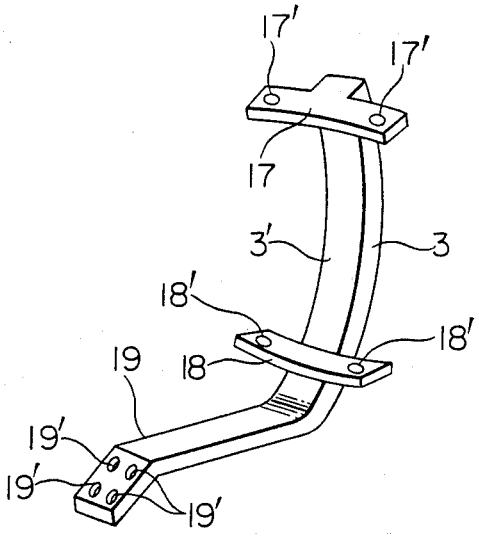
FIG. 4 is a perspective view showing an embodiment of a parabolic antenna fitting (3) integral with a converter mount arm according to the invention which is to be used, along with the FIG. 3 screw clampers, for the parabolic antenna shown in FIGS. 1 and 2.
Figure 5:
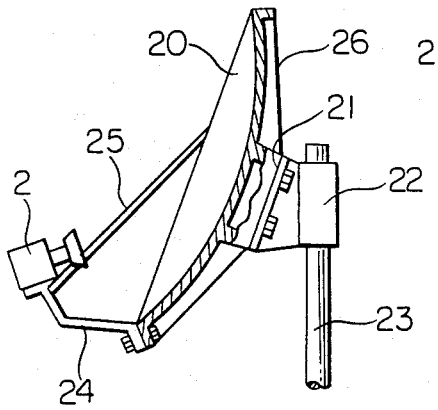
FIG. 5 PRIOR ART
FIG. 5 is a side view showing a prior art parabolic antenna fitted on an antenna support post with a parabolic refector sectioned.
Figure 6:
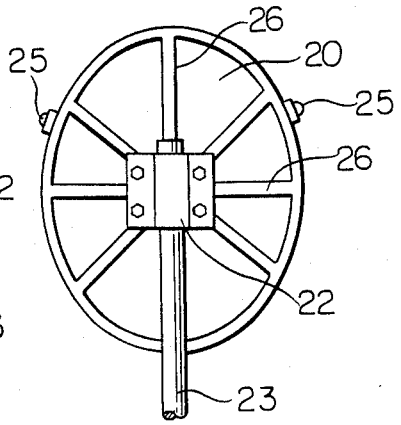
FIG. 6 PRIOR ART
FIG. 6 is a rear view of the FIG. 5 parabolic antenna.
Figure 7:
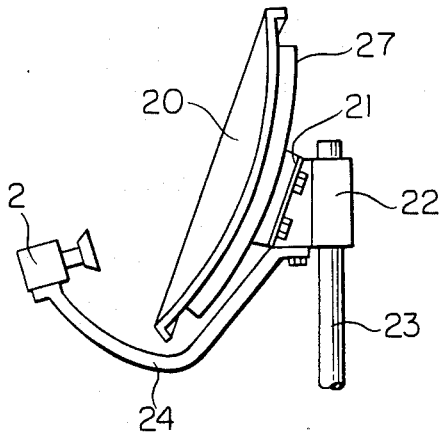
FIG. 7 PRIOR ART
FIG. 7 is a side view, partly sectioned, showing another prior art parabolic antenna with a converter mount arm directly connected to an antenna fitting.
Figure 8:
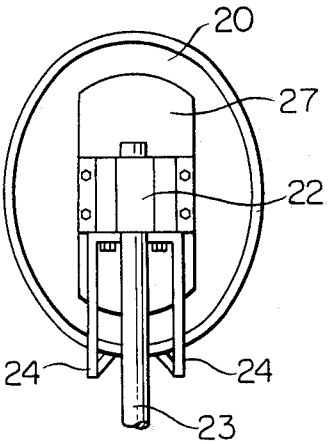
FIG. 8 PRIOR ART
FIG. 8 is a rear view of the FIG. 7 parabolic antenna.

In the front view of FIG. 1, the offset type parabolic antenna is fitted on an antenna support post 16 and a converter 2 is held in position at a focal point of the offset type parabolic antenna. In FIG. 2 illustrating a side view of FIG. 1, a parabolic reflector 1 is sectioned to clearly show that the parabolic reflector 1 has a flange 1' whose upper and lower portions aligned in the longitudinal axis direction A—A of the reflector 1 are respectively mounted fixedly to an upper fitting arm 17 and a lower fitting arm 18 of an antenna fitting 3 shown in FIG. 4. As best seen in FIG. 4, the antenna fitting 3 has a circular arc portion 3'. The antenna fitting 3 is a metal plate made of, for example, iron, stainless, or hard aluminum sheet and machined into a desired sectional configuration, such as a channel-shape, a rectangular pipe-shape or a circular pipe shape. The upper fitting arm 17 and lower fitting arm 18, exemplarily made of the same material as the antenna fitting 3, are secured to the antenna fitting 3 by, for example, welding or rivetting. Alternatively, these fitting arms 17 and 18 may originally be formed integrally with the antenna fitting 3 by machining them from the same metal plate. A converter mount arm 19 is formed integrally with the antenna fitting 3, but the fitting 3 and arm 19 may be separated int two parts, one is the curvature portion and the other one is the arm of converter mount whereby these parts can be made accurately.

The upper fitting arm 17 has two holes 17' in which screws 4 are fitted to fix the antenna fitting 3 to the upper portion of flange 1' of the parabolic reflector 1. Similarly, the lower fitting arm 18 has two holes 18' in which screws 5 are fitted to fix the antenna fitting 3 to the lower portion of flange 1' of the parabolic reflector 1. The radius of curvature of the antenna fitting 3 carrying the parabolic reflector 1 on its back is made large in accord with a design value of the parabolic reflector to assist in improving accuracy of setting the elevation coordinates. The antenna fitting 3 of a large radius of curvature has a small downward incline component by gravity when rotatably mounted on the support post for azimuth adjustment and advantageously, the azimuth adjustment can be carried out easily by the accuracy of setting elevation coodinates. Further, the reference numerals 4 and 5 indicate screws for fixing the reflector 1.

The fitting 3 need not be fixed to flange of the parabolic reflector but may be fixed to upper and lower portions of the parabolic reflector near its flange. This is achivied because the boundary area between the parabolic surface and flange of the parabolic reflector is also enhanced in mechanical strength by the flange. The converter 2 is fixedly mounted to an end flat portion of a converter mount arm 19, integral with the antenna fitting 3, by threading screws in flexing holes 19' in the end flat portion, in such a manner that the receiving portion of the converter 2 is placed in position at a focal point of the parabolic reflector 1. Thereafter, an upper portion of the antenna fitting 3 is clamped to the antenna support post 16 by using a screw clamper comprised of, as detailed in FIG. 3, a U-bolt screw 6, a fixture 7 and a bufferfly screw nut 8 at a desired point indicated on scale of elevation coordinates. The desired point is determined by a circumscribed position at which the portion in curvature portion 3' comes in contact with the support post 16.

A lower section curved portion 3' of the antenna fitting 3 is also clamped to the antenna support post 16 by using another screw clamper comprised of an elongated U-bolt screw 9, a U-bolt fixture 10, bufferfly screw nuts 11, 12 and 15, and post fixtures 13 and 14. Before finishing clamping, orientation of the parabolic antenna, especially, the elevation coordinates angle is adjusted by means of the post fixtures 13 and 14, and the bufferfly screw nuts 12 and 5 for fine adjustment. Subsequently, the butterfly screw nut 15 is tightened to complete clamping.

Since in this embodiment the back of the parabolic reflector 1 can be placed closely adjacent to the antenna fitting 3 and the U-bolts 6 and 9 can be fixed on the two portions of the antenna support post 16 directly, a bending moment about the support post due to a wind pressure can be decreased. It follows therefore that excessive strength is not required for the antenna fitting and the quantity of materials to be used for the antenna fitting can be reduced.

The parabolic antenna may be adjusted for azimuth by rotating the antenna support post 16 during installation of the antenna for reception. Preferably, however, azimuth is adjusted prior to tightening the bufferfly nut 8, followed by an adjustment of elevation to complete orientation of the parabolic antenna.

The embodiment described so far is advantageous for a number of reasons. Firstly, since the robust flange portions 1' or their neighbouring portions are fixed to the antenna fitting, the parabolic reflector will not be deformed permanently or fractured under the influence of a strong wind. This leads to a decreased thickness of the parabolic reflector, 1 elimination of the reinforcement ribs, a reduced quantity of materials used and a simplified structure. Secondly, because the converter mount arm 19 united with the antenna fitting in a body is not fixed to the parabolic reflector, the parabolic reflector is not affected by a strong wind. This also ensures the elimination of reinforcement for the parabolic reflection, the reduction in quantity of materials used and the simplicity of structure. Thirdly, because the antenna fitting 3 is integral with the converter mount arm 19, the mount stucture can be simplified to improve mounting accuracy of the converter 2 relative to the parabolic reflector 1 and besides, irregular reflection of the electric wave can be prevented to thereby permit the provision of a parabolic antenna of high receiving performance. Fourthy, the antenna fitting 3 of the present invention takes advantage of vertical longitudinal its axis direction similar to that of the antenna support post 16, thus ensuring that the antenna fitting can be fitted on the antenna support post 16 at two vertically spaced points by using the U-bolts and fixtures, and that azimuth can be adjusted desirably by using the support post 16 which may conveniently be cylindrical. In the fifth place, the parabolic reflector 1 of this invention has holes for fixing antenna fittings which use the cardinal line between the flange and the parabolic surface area as a criterion. According, when fixing the flange and the antenna fitting 3, positional accuracy can readily be determined from the criterion and fitting holes can easily be machined with high accuracy. In the sixth place, because of the pitch between the holes 17' and between the holes 18', and that of both of the holes 17' and 18' the member of assembling screws for fixing the parabolic reflector flange, can be minimized in accord with mechanical strength of the parabolic reflector as far as the parabolic reflector will not be deformed permanently, a wind pressure due to a strong wind exerting on the parabolic reflector can effetively be transmitted through the antenna fitting to the support post 16 and force loaded on the converter can also be transmitted effectively through the antenna fitting to the support post 16. In other words, the wind pressure and the force are independently transmitted to the support post and advantageously, they are not added together to deform the parabolic reflector 1. Finally, because the converter mount arm 19 is integral with the antenna fitting 3, the number of screws required for fixing the parabolic reflector and the converter can be decreased by at least two, normally, four to five. In other words, the number of points requiring screw tightening, which points are responsible for degradation in assembling accuracy can be decreased.

Figure 3:
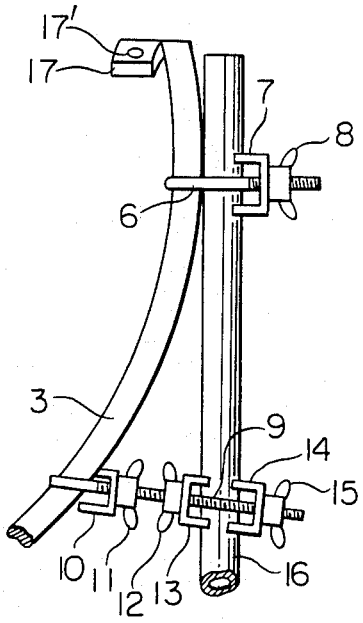
FIG. 3 is a enlarged fragmentary side view illustrating details of screw clampers using U-bolts and fixtures.

In the foregoing embodimemt, orientation of the parabolic antenna, especially, for elevation coordinates is adjusted by using the bufferfly nuts as shown in FIG. 3 but a parabolic antenna of this invention can be achived with the elevation coordinates adjusting device as shown in FIGS. 9 to 12.

Figure 9:
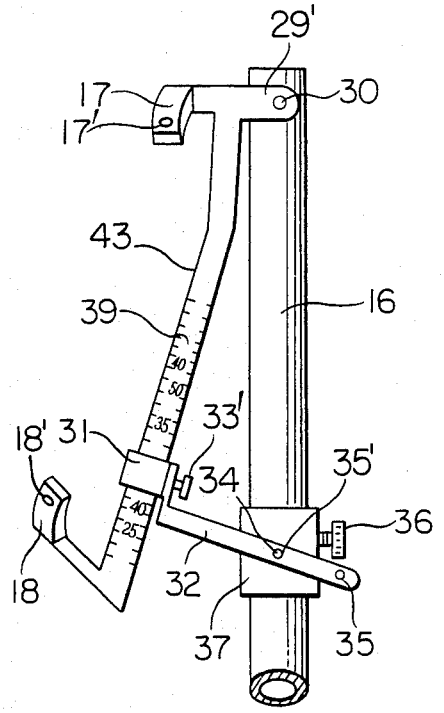
FIG. 9 is a fragmentary side view showing another embodiment of a parabolic antenna fitting according to the invention, connected to the antenna support post.

The essential part of another embodiment of an elevation coordinates adjusting device is illiustrated, in side view form, in FIG. 9 wherein a parabolic antenna fitting 2.9 and elevation coordinates setting lever 32 are connected to an antenna support post 16 and the elevation coordinates setting lever 32 has a elevation setting slider 31 which is slidably mounted on a linear slide rail 43. The linear slide rail 43 is graduated with the indication scale 39 of elevation coordinates. When mounting the antenna fitting 29, the elevation setting slider 31 is first set to a point indicated on the elevation scale which is determined for a district in question and settled there by means of a slider fixing screw 33'. Thereafter, the elevation setting lever 32 is fixed to a slider 37 by threading a screw 34 in the slider 37 through a corresponding indexing hole 35 or 35' formed in the elevation setting lever 32.

Before assembling the parabolic antenna, the support post 16 is secured vertically and rigidly to an independent or separate structure which is rotatable about its axis and mounted on a building or level land. The parabolic antenna is then connected to the support post 16 at predetermined design elevation coordinates and thereafter rotated about the axis of the support post 16 while measuring the output signal from the converter 2 for adjustment of azimuth until an optimum azimuth is obtained. At the optimum azimuth, the support post 16 is stopped and fixed against rotation. Subsequently, the slider fixing screw 33' is released and the elevation setting lever 32 is slightly moved in the vertical direction while measuring the output signal from the converter 2 until a maximum receiving condition is reached. Then, the slider fixing screws 33' and 36, a axis bolt 30 for elevation, and the screw 34 are tightened to complete installation of the parabolic antenna.

Figure 10:
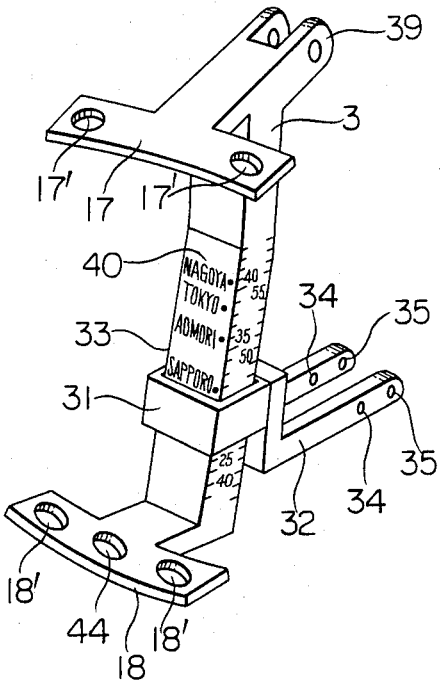
FIG. 10 is a perspective view showing an assembly of the FIG. 9 parabolic antenna fitting and an elevation coordinates angle setting lever.

FIG. 10 specifically illustrate, in perspective view , the combined assemblage of the parabolic antenna fitting and elevation setting lever. The antenna fitting 29 has a lower fitting arm 18 formed with a hole 44 for a converter mount arm fitting screw 38, in addition to holes 18' similar to those of FIG. 4. As best seen in FIG. 10, scales 39 indicatig elevation are cut on edge portions on both sides of the linear slide rails 43 to indicate elevation corresponding to the indexing holes 35 and 35', respectively, to extend the indication ability of the elevation coordinates. Further, and indication 40 of major capitals, for examples, Tokyo, Nagoya and so on, is labelled or printed on the slide rail with a view of assisting in the elevation adjustment.

Figure 11:
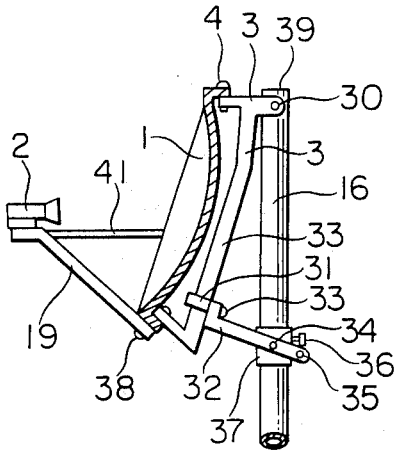
FIG. 11 is a side view, partly sectioned, showing a parabolic antenna according to another embodiment of the invention wherein a parabolic reflector is connected to the FIG. 9 fitting connected to the support post.

As shown in FIG. 11, the parabolic reflector is fixedly mounted to the antenna fitting connected to the support post as explained with reference to FIG. 9. Thus, the antenna fitting 29 has an upper lever 29' pivotally mounted on the support post 16 through the axis bolt 30 for elevation. The elevation setting lever 32 initially slidably mounted on the linear slide rail 43 through the elevation setting slider 31 is eventually fixed to the slider 37 slidable on the support post 16 by threading the screw 34 into the slider 37 through an indexing hole 35 or 35' in the elevation setting lever 32, which is selected for the elevation coordinates of the district installed antenna. Finally, the slider 37 is fixed to the support post 16 by tightening the screw 36.

By using screws 4 and 5, the antenna fitting 29 is fixedly mounted to the parabolic reflector 1 at upper and lower portions thereof which can are aligned on the vertical longitudinal axis B—B of the parabolic reflector 1. FIG. 11 also illustrates that a converter mount arm 19 is fixedly secured to the antenna fitting 29 by tightening the screw 38 applied at the holes 44 in the lower fitting arm 18 The converter mount arm 19 may alternatively be configured to be integral with the antenna fitting 29 as in FIG. 2. For simplicity of illustration, screws 5 for fixing the parabolic reflector 1 to the lower fitting arm 18 are not illustrated in FIG. 11.

Figure 12:
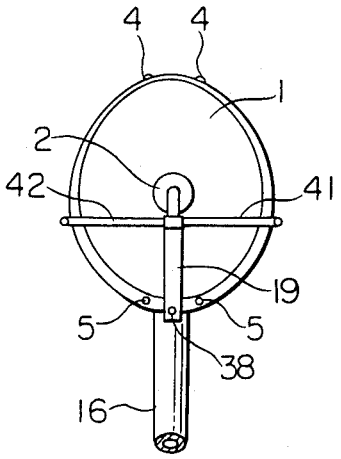
FIG. 12 is a front view of the FIG. 11 parabolic antenna.

Additionally, in this embodiment of parabolic antenna, the converter mount arm 19 threaded on the antenna fitting 29 is held in the mounting positioning by means of supports bars 41 and 42 which extend over the front surface of the parabolic reflector 1 without intercepting the effective area of the parabolic reflector, as shown in FIG. 12. These support bars 41 and 42 assist in holding the converter 2 in position at a focal point of the parabolic reflector for reception of radio waves.

According to the embodiment of FIGS. 9 to 12, since the elevation coordinates of parabolic reflector 1 are determined by the distance between the elevation setting lever 32 slidably mounted on the linear slide rail 43 at a predetermined elevation and the axis bolt 30, the indication scale 39 of elevation coordinates can be graduated over a wide range on the linear slide rail 43 and used for mounting the elevation setting lever 32 which is held in position at a corresponding indexing hole 35, or 35' with high accuracy of setting elevation.

The parabolic reflector 1 of the offset type has predetermined elevation coodinates. Therefore, the mount of adjustments of the elevation is relatively small at all northern extremity of Hokkaido and the elevation setting lever 32 is necessarily short, requiring the use of the inner indexing hole 35'. In contrast, the amount of adjustment of elevation is relatively large at the southern extremity of Kyushu and the outer indexing hole 35 is used. In this manner, the indication scale of elevation coordinates within the predetermined range can be used in two indication modes to extend the range of adjustments of elevation coordinates with the result that the installation accuracy can be doubled and the installation can be facilitated. Obviously, if three indexing holes are provided, the wave angle indication scale can be used in three modes.

In this ebodiment, the antenna fitting cooperates with the elevation setting slider which is simply moved vertically for adjustment of the elevation, and there is no need of providing such a bulky adjusting device of elevation coordinates as using an adjusting screw. Because of the absence of any bulky structure between the parabolic reflector 1 and the support post 16, the two can be disposed closely and the parabolic antenna can be manufactured inexpensively.

Moreover, a wind pressure or the like on the parabolic reflector is transmitted as dispersed loading to the support post 16 through the axis bolt 30, on the one hand, and through the elevation setting lever 32 and screw 34 on the other hand. Therefore, the antenna support can withstand against wind load and yet can be formed from a smaller amount of materials at lower cost.

As has been described, the present invention is well adapted to provide a parabolic antenna of less degradation of efficiency of gain.

We claim:

1. A parabolic antenna comprising:

a parabolic reflector having a concave reflecting surface with a focal point;

antenna fitting means mounted at a convex back surface of the parabolic reflector, said antenna fitting means including a first fitting means rigidly fixed to an upper portion of the parabolic reflector, a second fitting means rigidly fixed to a lower portion of the parabolic reflector, and a rigid member with a convex back surface fixed between the first and second fitting means so as to extend along a central axis of the parabolic reflector sush that said first and second fitting means, said rigid member and said parabolic reflector form a unitary structure;

mount arm means fixedy associated with said antenna fitting means for mounting a converter at the focal point of the parabolic reflector;

a support member for supporting said antenna fitting means with the convex back surface of the rigid member contiguous with the support member; and means for setting elevation coordinates of the parabolic reflector, including clamping means for permitting relative adjustment between the rigid member and the support member and for clamping the rigid member to the support member at a desired elevational position.

2. A parabolic antenna according to claim 1, wherein said rigid member has a curvature portion.

3. A parabolic antenna according to claim 2, wherein said clamping means includes upper clamper means for clamping an upper portion of said curvature portion to said support member and lower clamper means for clamping a lower portion of said curvature portion to said support member to obtain a desired spacing.

4. A parabolic antenna according to claim 3, wherein said upper clamper means clamps said curvature portion to said support member at a desired elevation coordinates angle determined by a position at which said curvature portion is kept in contact with said support member.

5. A parabolic antenna according to claim 3, wherein said lower clamper means provides means for adjustment of elevation coordinates of said parabolic antenna.

6. A parabolic antenna according to claim 2, wherein the curvature portion is concave in the same direction as the concavity of the reflector.

7. A parabolic antenna according to claim 1, wherein the rigid member has a linear slide portion.

8. A parabolic antenna according to claim 7, wherein said support member pivotally supports said antenna fitting means.

9. A parabolic antenna according to claim 8, wherein said clamping means has a first member for sliding along said slide portion, a second member for sliding along said support member and a third member for keeping a desired distance between said first and second members.

10. A parabolic antenna according to claim 7, wherein said slide portion has at least one of an indication scale of the elevation coordinates and an indication of place names.

11. A parabolic antenna according to claim 1, wherein said mount arm means and said antenna fitting means are formed in one integrated body.

12. A parabolic antenna comprising:

a parabolic reflector having a concave reflecting surface with a focal point;

antenna fitting means mounted at a convex back surface of the parabolic reflector, said antenna fitting means including a first fitting means rigidly fixed to an upper portion of the parabolic reflector, a second fitting means rigidly fixed to a lower portion of the parabolic reflector, and a rigid member fixed between the first ans second fitting means so as to extend along a central axis of the parabolic reflector such that said first and second fitting means, said rigid member and said parabolic reflector form a unitary structure;

mount arm means fixedly associated with said antenna fitting means and said parabolic reflector for mounting a converter at the focal point of the parabolic reflector;

a support member having one of the first and second fiting means pivotally associated therewith; and means for setting elevation coordinates of the parabolic reflector including a setting member having a first 335tion slidable relative to the rigid member so as to be clamped to a desired position therealong and a second portion with means for permiting relative sliding along and pivoting with respect to the support member and for clamping the setting member at a desired position along the support member such that the elevation setting means sets the parabolic reflector at a desired elevation position.

* * * * *